US006300970B1

(12) United States Patent
Hamada et al.

(10) Patent No.: US 6,300,970 B1
(45) **Date of Patent: *Oct. 9, 2001**

(54) IMAGE FORMING APPARATUS HAVING A DETACHABLY MOUNTED SHEET SUPPLY ROLLER

(75) Inventors: Tatsuo Hamada, Abiko; Nobukazu Adachi, Yokohama, both of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/152,664

(22) Filed: Sep. 14, 1998

(30) Foreign Application Priority Data

Sep. 16, 1997 (JP) ..... 9-250893
Sep. 10, 1998 (JP) ..... 10-256240

(51) Int. Cl.[7] ..... B41J 2/435; G03G 21/16

(52) U.S. Cl. ..... 347/264; 347/153; 399/25; 399/111; 399/388; 400/629

(58) Field of Search ..... 347/262, 264, 347/215, 153; 399/110, 111, 114, 393, 405, 25, 124, 388; 400/600.1, 600.2, 600.3, 624, 625, 629, 641, 163.1

(56) References Cited

U.S. PATENT DOCUMENTS 4,806,977 2/1989 Mizutani et al. ..... 399/111
4,810,115 * 3/1989 Hori ..... 400/163.1
5,208,626 * 5/1993 Tanimoto et al. ..... 355/200
5,331,374 * 7/1994 Abe et al. ..... 355/200
5,884,117 * 3/1999 Tanoue et al. ..... 399/110
5,896,206 * 4/1999 Kellogg ..... 358/498

FOREIGN PATENT DOCUMENTS 0 487 041 5/1992 (EP) .
0 621 515 10/1994 (EP) .
0 679 958 11/1995 (EP) .
61-178334 8/1986 (JP) .
06-92489 4/1994 (JP) .

* cited by examiner

*Primary Examiner*—N. Le
*Assistant Examiner*—Hai C. Pham
(74) *Attorney, Agent, or Firm*—Fitzpatrick, Cella, Harper & Scinto

(57) ABSTRACT

The present invention provides an image forming apparatus including a sheet supply device having a detachable sheet supply roller for feeding stacked sheets, an image forming device having a process cartridge for forming an image on the sheet fed by the sheet supply device, a cartridge containing portion for detachably containing the process cartridge within a body of the image forming apparatus, and a sheet discharge device for discharging and stacking the sheets on which the images were formed by the image forming device. The sheet supply roller and the process cartridge are disposed adjacent to each other, and, after the process cartridge is disengaged from the cartridge containing portion, the sheet supply roller is mounted and dismounted through the cartridge containing portion.

39 Claims, 8 Drawing Sheets

IMAGE FORMING APPARATUS HAVING A DETACHABLY MOUNTED SHEET SUPPLY ROLLER

BACKGROUND OF THE INVENTION

1. Field of the Invention

The present invention relates to an image forming apparatus such as a laser beam printer, a copying machine, a facsimile and the like and an improvement in a sheet supply portion of such an apparatus.

2. Related Background Art

Recently, laser beam printers have been made more compact and inexpensive, with the result that the laser beam printers which were used under limited conditions such as office equipment and/or business purposes have been used in private offices and/or homes since personal computers have progressed. To this end, the laser beam printers themselves have been improved so that the performance thereof is enhanced and so that they can easily be used by any person. For example, by only opening an open/close cover, the user himself can easily exchange consumed parts such as a process cartridge and easily effect jam treatment.

Further, in the past, a large number of sheets having certain characteristics recommended by electrophotographic makers were used. However, recently, various kinds of paper sheets (for example, no-brand low cost sheets, ink jet printing sheets and the like) available from stationery shops or discount stores have frequently been used. Further, for an individual, a user may use various sheets such as a post card, a letter-paper, an envelope and sheets having various thicknesses.

Since such sheets may have features different from features of sheets to be used in the apparatuses recommended by the makers, various problems may occur. For example, some kinds of paper sheets may reduce a friction force of a sheet supply roller for supplying a sheet to the laser beam printer, thereby causing poor sheet supply. More particularly, a coating on the sheet, a pigment coated on the sheet and/or additives to the sheet (talc, calcium carbonate or Kaolin) can adhere to and accumulate on a surface of the sheet supply roller, and, a rubber surface of the sheet supply roller is worn by a rough surface of the sheet or fibers of the sheet, thereby causing such problems.

Such sheet supply roller must be cleaned by using a solvent such as alcohol, or the sheet supply roller itself must be exchanged. However, since the solvent such as alcohol may not easily be available and the sheet supply roller cannot easily be exchanged by the user (even when the improvement is made so that anyone can handle the apparatus easily), generally, the user leaves repair of the apparatus to the maker.

To avoid this, it is requested to provide an arrangement in which any user can easily exchange the sheet supply roller. However, the conventional arrangements have the following disadvantages.

(1) Since the sheet supply roller is disposed within the body of the apparatus, a space available to exchange the sheet supply roller is small.

(2) As shown in FIG. 7A, in general, in a sheet supply roller unit 100, a sheet supply roller 101, a sheet supply sub-roller 102 and cams 106, 109 are fitted on a sheet supply shaft 104 and are secured to the sheet supply shaft by fixing members 103, 105, 108 and 110. When parts are exchanged, the unit 100 integrally including the sheet supply shaft 104 is dismounted from a body of the apparatus, and, as shown in FIG. 7B, the sub-roller 102 and the fixing members (parallel pins) 103, 105 provided on the shaft are slid along a longitudinal direction of the shaft to be removed. Accordingly, it is difficult for the user to exchange the sheet supply roller.

(3) A sheet supply roller unit 122 shown in FIG. 8 includes a rubber portion 122*a* having a high coefficient of friction and a sheet supply roller metal core 122*b*. In this unit, the user can easily exchange the sheet supply roller only by disengaging a pawl 122*c* of a snap fit 122*d* provided on the metal core 122*b* from a recess 120*a* provided in a shaft 120 and sliding the roller laterally. However, as shown in FIG. 8, the exchange of the sheet supply roller can be effected only when the sheet supply roller is supported by a bearing portion 121 in a cantilever fashion and other parts are not provided on the shaft. Other arrangements cannot be used.

SUMMARY OF THE INVENTION

An object of the present invention is to permit easy exchanging by a user of a sheet supply roller in an image forming apparatus.

To achieve the above objects, according to the present invention, there is provided an image forming apparatus comprising a sheet supply means having a detachable sheet supply roller for feeding stacked sheets, an image forming means having a process cartridge for forming an image on the sheet fed out by the sheet supply means, a cartridge containing portion for detachably containing the process cartridge within a body of the image forming apparatus, and a sheet discharge means for discharging and stacking the sheets on which the images were formed by the image forming means. Wherein, the sheet supply roller and the process cartridge are disposed adjacent to each other, and, after the process cartridge is disengaged from the cartridge containing portion, the sheet supply roller is mounted and dismounted through the cartridge containing portion.

DETAILED DESCRIPTION OF THE PREFERRED EMBODIMENTS

An embodiment of the present invention will now be fully explained with reference to FIGS. 1, 2A, 2B, 2C, 3, 4A, 4B and 4C.

Figure 1:
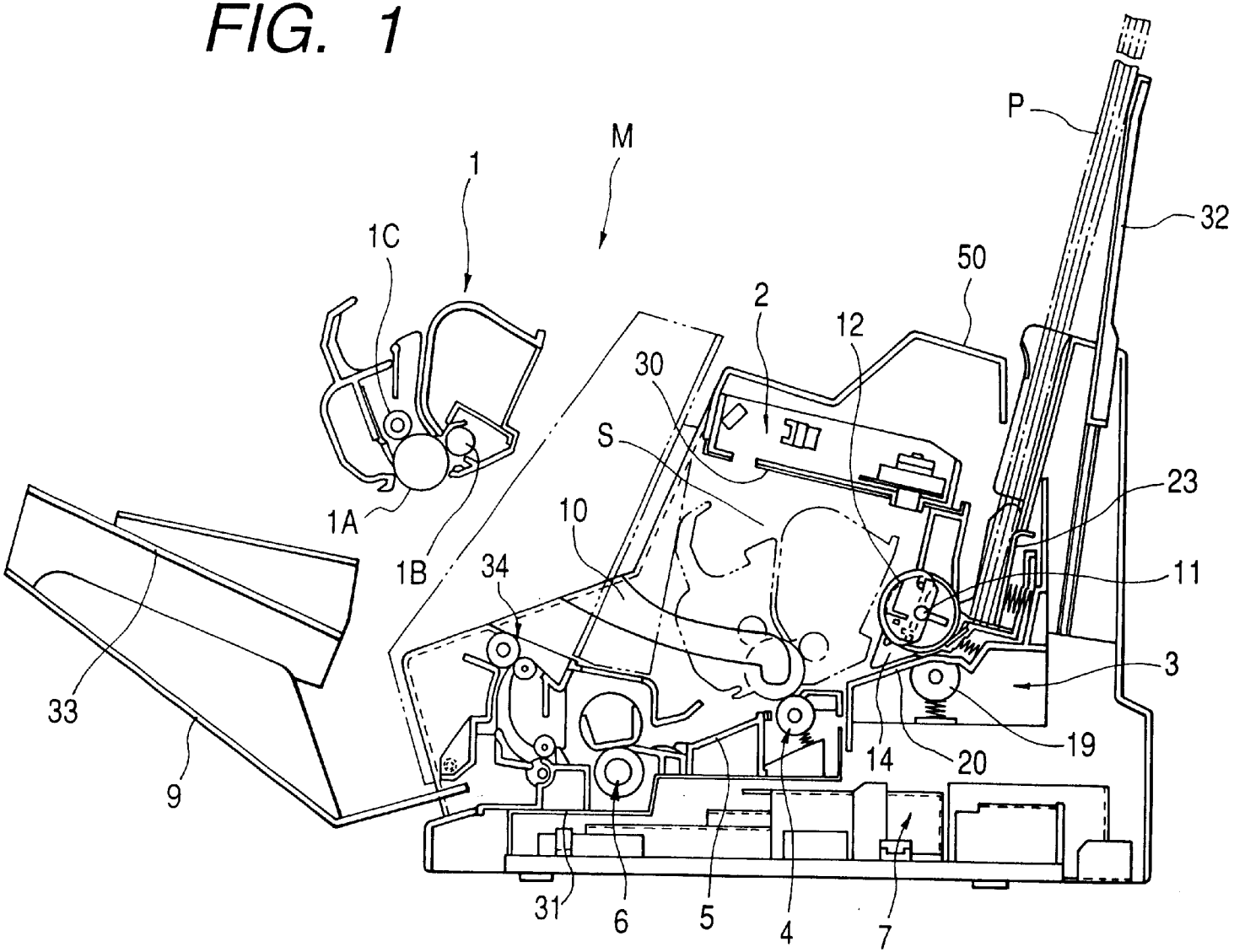
FIG. 1 is a sectional view of an image forming apparatus to which the present invention is applied.

FIG. 1 schematically shows a laser beam printer M (referred to merely as "printer M" hereinafter) using a detachable process cartridge, as an example of an image forming apparatus according to the present invention. A conveying direction of a recording sheet P has an upstream side (right side) and a downstream side (left side) in FIG. 1. Although the recording sheet P may be a thick sheet, a special sheet such as an envelope, or film sheet such as OHP sheet, as well as a normal sheet, the normal sheet is used as the recording sheet in the illustrated embodiment.

In the printer M, a sheet supply tray 32 for supporting the recording sheets P (before image formation) longitudinally or vertically is provided at an upstream side of a printer body 50 (referred to merely as "body 50" hereinafter) in a recording sheet supplying direction (rear or remote side of the body 50), and a sheet discharge tray 33 for supporting the recording sheets P (after image formation) longitudinally is provided at a downstream side of the body 50 (front or near side of the body 50).

A lower end of the sheet supply tray and a lower end of the sheet discharge tray are interconnected within a convey path extending from the right to the left (from the rear side to the front side) of the body 50 in FIG. 1 so that a sheet supply portion 3, a process cartridge 1 and a fixing portion 6 are arranged adjacent to each other as much as possible, thereby providing a compact U-shaped path (referred to as "vertical U-shaped path" hereinafter). The process cartridge 1 incorporates therein at least a photosensitive drum (image bearing member) 1A on which an electrostatic latent image is formed in an electrophotographic manner and a developing means having a developing sleeve 1B (if necessary, process means such as a charge means 1C may be added) as a cartridge unit which can be detachably mounted to the body of the image forming apparatus.

A body frame includes left and right side plates (not shown), a central stay member 31, a top plate 30 on which a laser scanner 2 for forming the latent image on the photosensitive drum 1A is mounted, and a bottom plate on which an electric portion 7 is mounted. A transfer portion 4, a convey guide portion 5 and the fixing portion 6 are mounted on the stay member 31.

In a condition that an open/close cover 9 having the sheet discharge tray 33 is opened by shifting it from a position shown by the two dot and chain line to a position shown by the solid line, the process cartridge 1 is inserted into a cartridge containing portion S along guide portions 10 provided on both sides of the body 50 to be held at a predetermined position. The open/close cover 9 is provided with a switch (now shown) so that when the open/close cover is opened a main power source is turned OFF, and when the open/close cover is closed the main power source is turned ON.

The sheet supply portion 3 is provided at a rear side of the process cartridge 1 and a sheet supply roller 12 is disposed at the center of the sheet supply portion, so that, after the open/close cover 9 is opened, when the process cartridge 1 is dismounted, an operator can easily access the sheet supply roller 12 through the cartridge containing portion S.

A sheet supply roller unit for supplying a recording sheet according to the present invention is constituted by a sheet supply shaft 11 (described later), a sheet supply roller support member provided on the sheet supply shaft, and the sheet supply roller 12 supported by the support member. A sheet supply means is constituted by the sheet supply tray 32 and the sheet supply portion 3, and a sheet discharge means is constituted by a pair of discharge rollers 34 and the sheet discharge tray 33.

The recording sheets P stacked on the sheet supply tray 32 are separated and supplied one by one by the sheet supply portion 3, and the separated recording sheet is conveyed by a convey roller 19 downstream inclined downwardly by about 20 degrees within the electrophotographic apparatus. The recording sheet P is sent to a nip between the photosensitive drum 1A and the transfer portion 4, where a toner image formed on the drum is transferred onto the recording sheet. Then, the recording sheet is sent to the fixing portion 6, where the toner image is thermally fixed to the recording sheet. Thereafter, the recording sheet is discharged onto the sheet discharge tray 33 by the pair of discharge rollers 34.

Explaining the sheet supply portion 3 in more detail, as shown in FIGS. 2A to 2C, 3 and 4A to 4C, the sheet supply portion includes an intermediate plate 23 for urging the recording sheet P against the sheet supply roller 12 by a spring 22, a frictional separation means 18 biased toward the sheet supply roller 12 by a spring 21 disposed between the separation means and the body frame 20 in order to separate the recording sheets one by one by a friction force, a semi-circular sheet supply roller 12 attached to a sheet supply shaft 11 and arranged at the center of the recording sheet, sheet supply sub-rollers 13 disposed on both sides of the sheet supply roller, cams 16, 17 provided on both ends of the shaft 11 and adapted to push the intermediate plate 23 downwardly, and a clutch (not shown) for controlling one revolution of the sheet supply roller and the cams.

A guide member 14 for guiding the recording sheet P separated by the sheet supply roller 12 and the frictional separation means 18 is rotatably supported on the sheet supply shaft 11, and a driven sub-roller 15 opposed to the convey roller 19 provided on the body frame 20 is provided on the guide member 14. The recording sheet P conveyed by the convey roller 19 is guided toward an image forming portion of the process cartridge 1 between the guide member 14 and a body frame portion 20 located below the guide member.

Figure 2A:
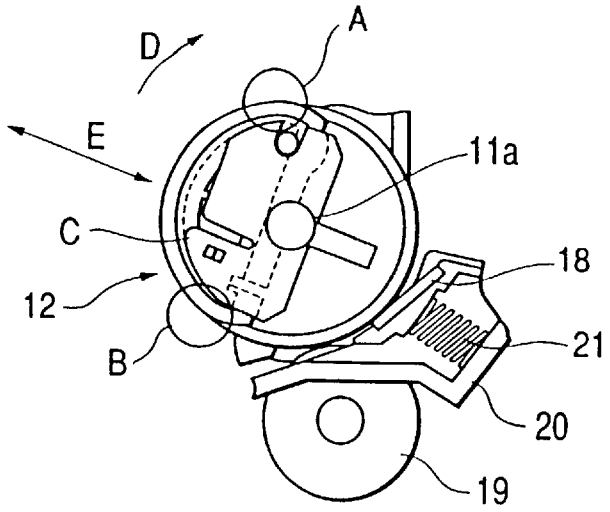
FIGS. 2A, 2B and 2C are partial enlarged explanatory views showing a mounting/dismounting arrangement of a sheet supply roller of the image forming apparatus of FIG. 1.
Figure 2B:
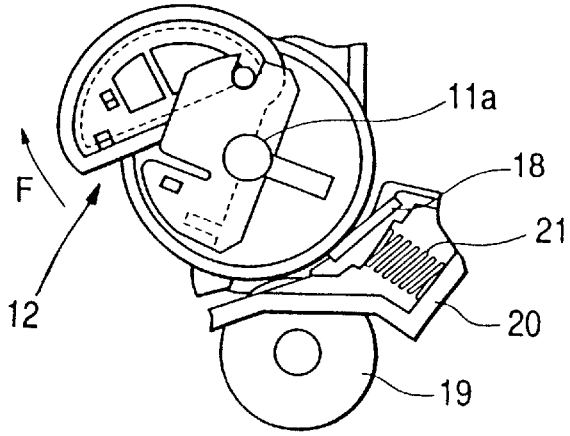
Figure 2C:
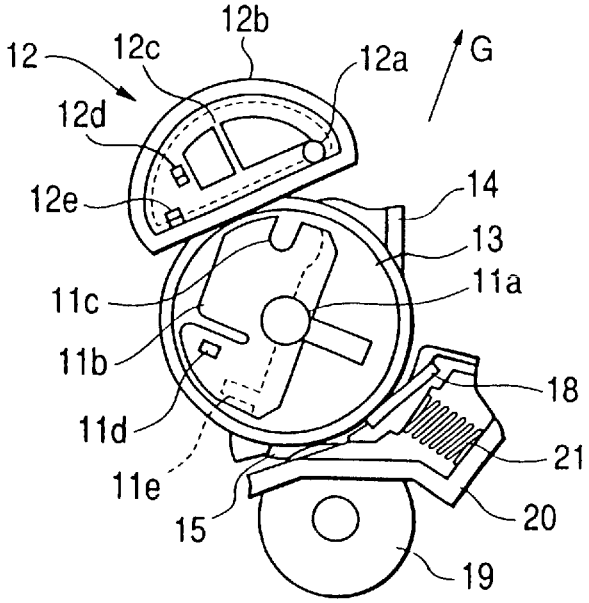
Figure 3:
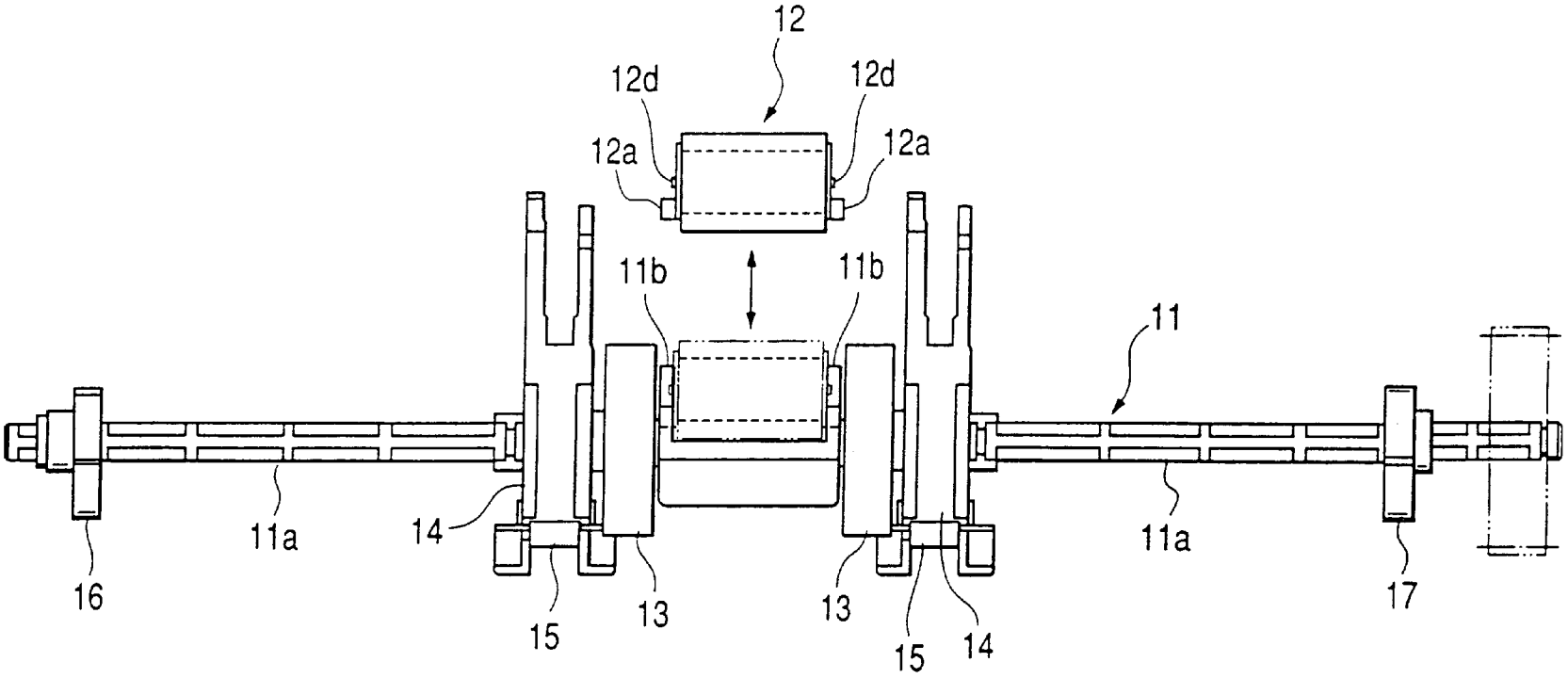
FIG. 3 is a front view showing the main part of FIGS. 2A, 2B and 2C.

As shown in FIGS. 2A to 2C, the sheet supply roller 12 has a rubber portion 12*b* formed from a member having a high coefficient of friction, and a metal core portion 12*c*, and the rubber portion has a cylindrical shape and the metal core portion has a solid or hollow cylindrical shape. First positioning projections 12*a* are provided on the metal core portion in the vicinity of a portion A (referred to as "sheet supply tip end portion" hereinafter) which is contacted with the recording sheet in the initial sheet supply condition when the sheet supply roller 12 is rotated in a direction shown by the arrow D in FIG. 2A, and the projections may be pins as shown, for example.

Further, second projections 12*d* and third slit-shaped recesses 12*e* are provided at both sides of the metal core portion in the vicinity of a portion B (referred to as "sheet supply trail end portion" hereinafter) which is contacted with the recording sheet in the last sheet supply condition when the sheet supply roller is rotated in the direction shown by the arrow D. Preferably, each projection 12*d* is a prismatic projection having a square cross-section. The projections 12*a*, 12*d* and the recesses 12*e* act as a locking means for the roller support member and the sheet supply roller, which will be described later.

At a central portion of a shaft portion 11*a* of the sheet supply shaft 11, outside of the sheet supply roller 12, there are provided elastic sheet supply roller support plates 11*b* formed integrally or formed independently from the shaft portion 11*a*. The sheet supply roller support plates 11*b* are provided at their sheet supply tip end portion sides with first recesses 11*c* adapted to be engaged by the sheet supply roller positioning projections 12*a* and are provided at their sheet supply trail end portion sides with second recesses 11*d* adapted to be engaged by the second projections 12*d* of the sheet supply roller. For example, each second recess is a square hole. When the sheet supply roller is inserted between the roller support plates, the second projections are snap-fitted into the second recesses. The first projections and recesses, and second projections and recesses constitute first and second locking means, respectively.

At the sheet supply trail end portion side within the sheet supply roller support plates 11*b,* there are provided rib-shaped projections 11*e* adapted to be engaged by the slit-shaped recesses 12*e* of the sheet supply roller to effect the positioning of the sheet supply roller 12, and these projections and recesses constitute a third locking means.

In this way, the positioning of the sheet supply roller 12 with respect to the sheet supply roller support plates 11*b* in a direction E is effected by the first projections 12*a* and recesses 11*c,* second snap-fit projections 12*d* and recesses 11*d,* and third recesses 12*e* and projections 11*e,* and, the positioning of the sheet supply roller in a direction G is effected by fitting the third projections 11*e* into the third recesses 12*e.*

Figure 4A:
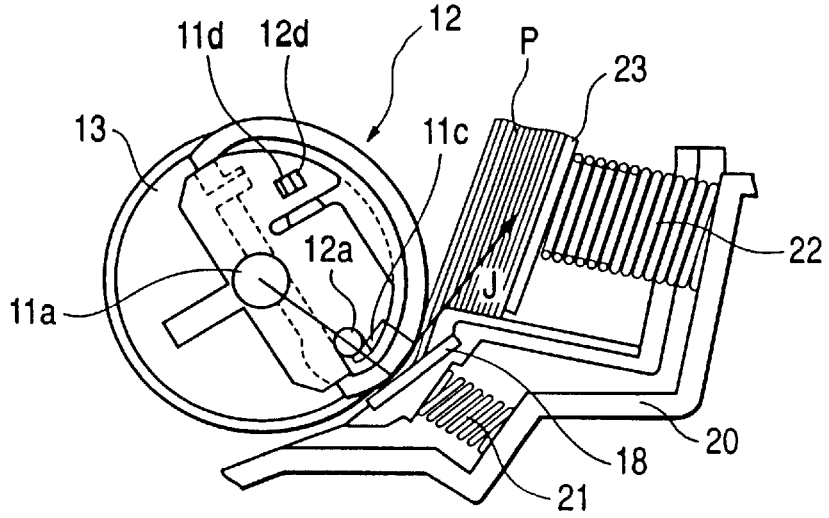
FIGS. 4A, 4B and 4C are explanatory views showing a sheet supplying condition of the sheet supply roller of FIG. 1.
Figure 4B:
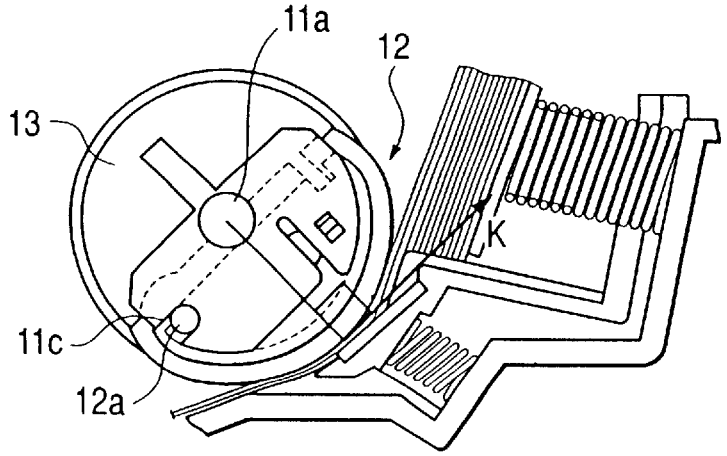
Figure 4C:
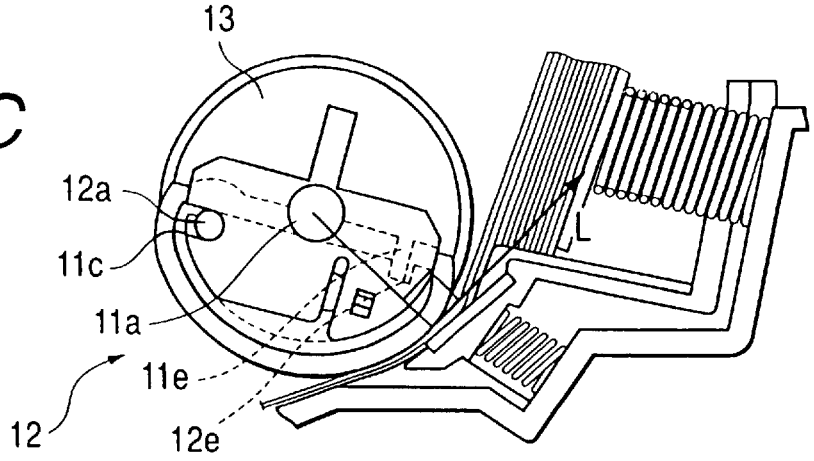

In the sheet supply roller 12 so attached, as shown in FIGS. 4A to 4C, a force applied in the sheet supplying operation is dispersed to prevent occurrence of any play and flexion. That is to say, FIG. 4A shows a condition where the recording sheet P is supplied at the sheet supply tip end portion A immediately after the sheet supplying operation is started. In this condition, due to a reaction force, the sheet supply roller 12 tries to shift toward a direction shown by the arrow J to be separated from the support plates 11*b.* However, since the first projections 12*a* are positively fitted into the recesses 11*c* to receive the force, the snap-fit portion at the sheet supply trail end side is not subjected to any force, so that the attachment position of the sheet supply roller 12 is stabilized.

FIG. 4B shows a sheet supplying middle condition. Also in this condition, since the first projections 12*a* are positively fitted into the recesses 11*c* so that the force K acting on the sheet supply roller 12 is supported by the projections 12*a,* no problem occurs. FIG. 4C shows a condition that the recording sheet P is supplied at the sheet supply trail end portion B immediately before the sheet supplying operation is completed. In this condition, due to the reaction force, the sheet supply roller 12 is biased toward the support plates 11*b* (direction shown by the arrow L). However, since the third positioning projections 11*e* are positively fitted into the third recesses 12*e* and the support plates 11*b* are rigid, the snap-fit portion at the sheet supply trail end side is not subjected to any force, with the result that the attachment position of the sheet supply roller 12 is stabilized.

When the sheet supply roller 12 is replaced the open/close cover 9 is opened as shown in FIG. 1 and the process cartridge is removed, so that the sheet supply roller can be replaced through the cartridge containing portion S. In this case, by removing the process cartridge 1, the great working space for exchanging the sheet supply roller can be ensured.

As shown in FIG. 2A, portions C of the sheet supply roller support plates 11*b* are widened or bent in opposite directions to release the snap-fit, and the sheet supply roller 12 is rotated around the first projections 12*a* in a direction shown by the arrow F. Then, as shown in FIG. 2C, the sheet supply roller 12 is slid in a direction shown by the arrow G to disengage the first projections 12*a* from the recesses 11*c.* In this way, the sheet supply roller can easily be dismounted. On the other hand, when the sheet supply roller is mounted on the sheet supply shaft, since the reverse operation may be effected, the user can easily exchange the sheet supply roller.

Figure 8:
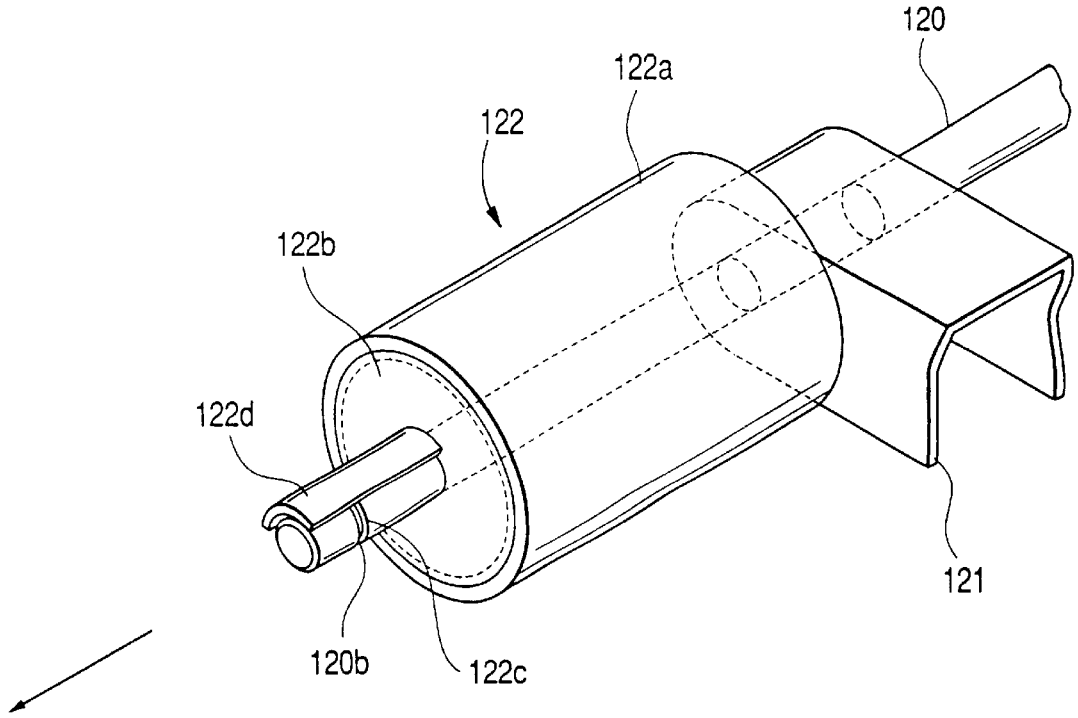
FIG. 8 (PRIOR ART)
FIG. 8 is a perspective view showing a conventional sheet supplying apparatus using a shaft supported in a cantilever fashion.

Since the detect means for detecting the open or close condition is provided on the open/close cover, when the open/close cover is opened to perform the exchanging operation, the high voltage power source for driving the apparatus is turned OFF on the basis of a signal from the detect means. With this arrangement, even in a construction in which the sheet supply roller can be mounted and dismounted in a direction perpendicular to the sheet supply roller, the metal core portion is not required to be supported in a cantilever fashion as shown in FIG. 8 but can be supported with sufficient strength.

Incidentally, in the present invention, other than the above-mentioned arrangement, an arrangement in which after the open/close cover is opened the process cartridge is removed and then by opening another cover or sheet guide the exchange of the sheet supply roller is permitted may be used. Further, in the illustrated embodiment, while an example that the sheet supply roller is mounted and dismounted along the direction perpendicular to the sheet supply shaft was explained, the sheet supply roller may be mounted and dismounted along a longitudinal direction of the shaft. Further, the projections and recesses (as locking means) provided on the sheet supply roller and the roller support members may have a reverse relation (i.e., provided on the roller support members and the sheet supply roller).

Figure 5A:
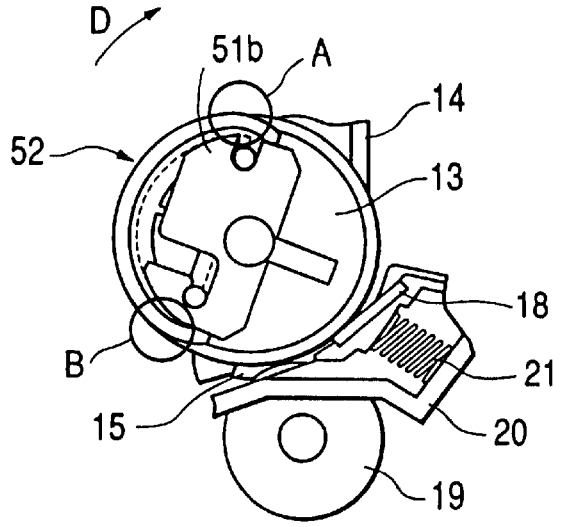
FIGS. 5A, 5B and 5C are partial enlarged explanatory views showing another mounting/dismounting arrangement of a sheet supply roller.
Figure 5B:
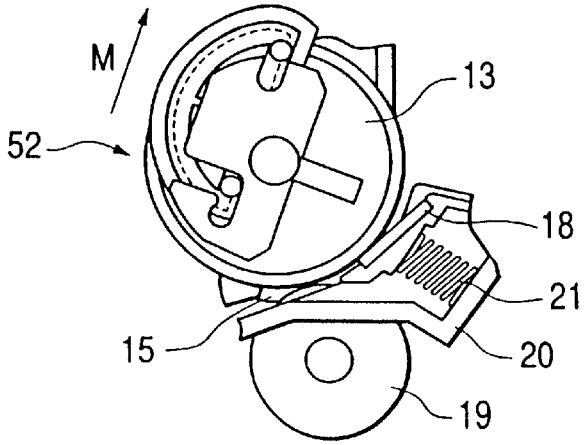
Figure 5C:
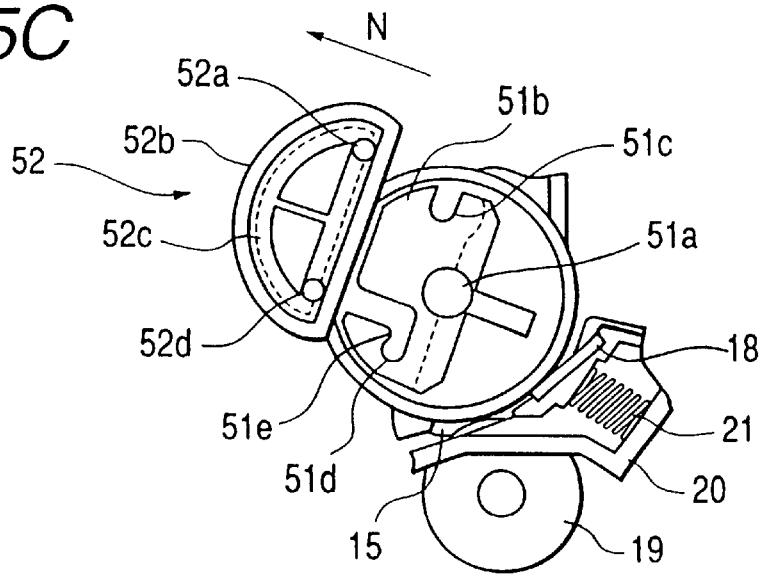

FIGS. 5A to 5C show another embodiment for mounting and dismounting a sheet supply roller. Reference numerals that are the same as those in FIGS. 2A to 4C represent like items. A sheet supply roller 52 is constituted by a semicircular rubber portion 52*b* and a metal core portion 52*c,* similar to the sheet supply roller shown in FIGS. 2A to 2C, and these portions have a semi-circular cylindrical shape. When it is assumed that the sheet supply roller 52 is rotated in a direction shown by the arrow D, first and second projections (positioning pins) 52*a,* 52*d* are provided on both sides of the metal core in the vicinity of a sheet supply tip end portion A and a sheet supply trail end portion B, respectively.

At a central portion of a shaft portion 51*a,* outside of the sheet supply roller 52, there are provided sheet supply roller support plates 51*b* formed integrally or formed independently from the shaft portion 51*a,* and the sheet supply roller support plates 51*b* are provided at their sheet supply tip end portion sides with first recesses (straight grooves) 51*c* adapted to be engaged by the sheet supply tip end side positioning pins 52*a* and provided at their sheet supply trail end portion sides with second recesses (L-shaped grooves) 51*d* adapted to be engaged by the sheet supply trail end side positioning pins 52*d.* Each L-shaped groove is constituted by an inlet side groove, and a rear side groove extending perpendicular to the inlet side groove 51*c* and parallel with the straight groove. Projections 51*e* for snap-fitting the pins 52*d* are provided at the entrance of the sheet supply trail end side grooves 51*d* to make the grooves narrower.

Fig. 5A shows a sheet supply permitting condition in which the sheet supply roller 52 is mounted on the sheet supply shaft. When the sheet supply roller is dismounted, the sheet supply roller 52 is shifted along the rear side grooves of the L-shaped grooves 51*d* extending in parallel with a first diametrical direction (direction M) of the sheet supply shaft and the grooves 51*c,* thereby disengaging the first and second projections 52*a,* 52*d* from these grooves. Then, by shifting the second projections 52*d* along the inlet side grooves of the L-shaped grooves 51*d* extending in parallel with a second diametrical direction (direction N) perpendicular to the first diametrical direction, the sheet supply roller 52 can be dismounted from the sheet supply shaft 51*a* or the roller support plates 51*b*. When the sheet supply roller is mounted on the sheet supply shaft, a reverse operation may be effected.

Incidentally, projections similar to the snap-fitting projections 51*e* may be provided in association with the first recesses 51*c*.

Figure 6:
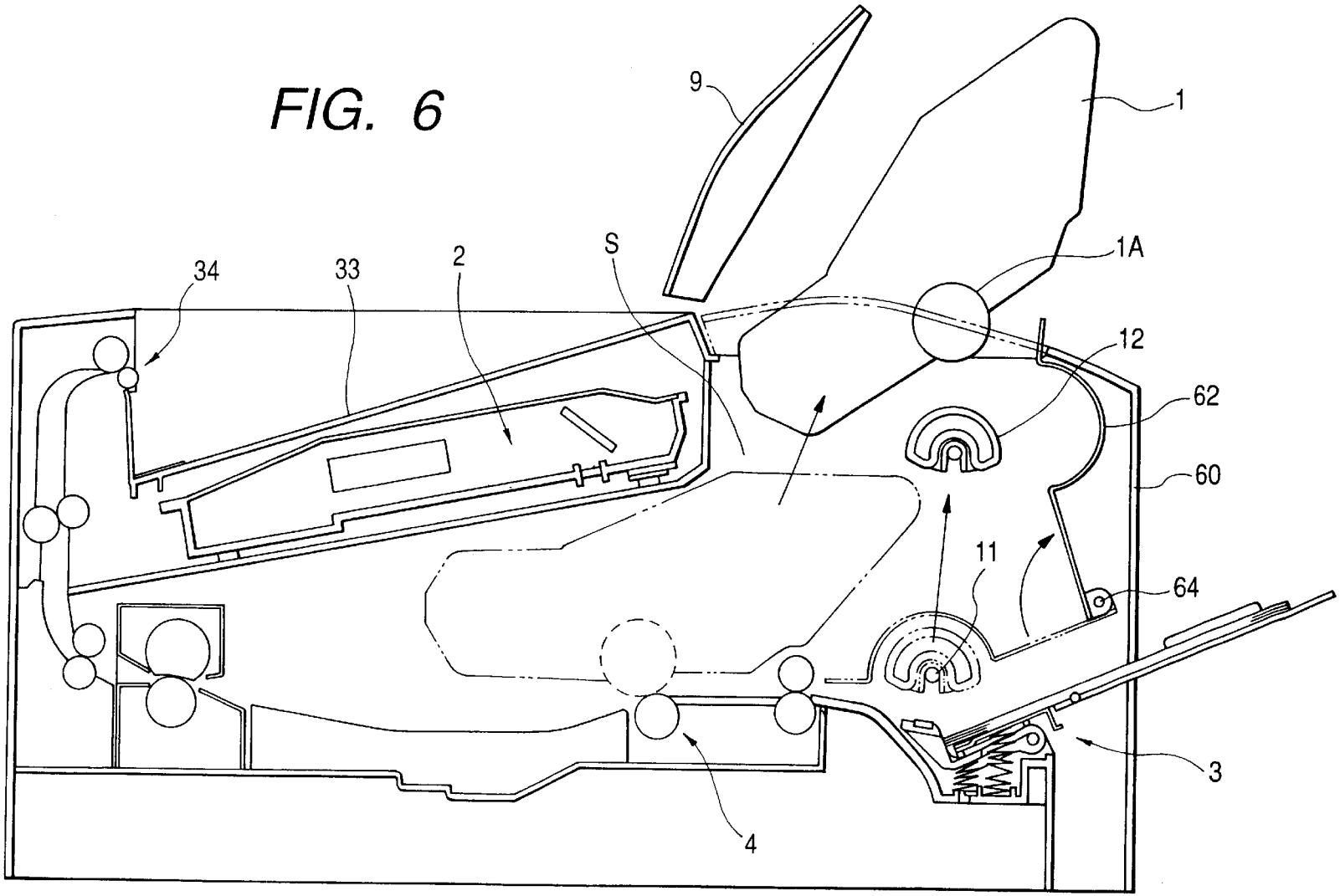
FIG. 6 is a view showing an embodiment in which a detachable sheet supply roller is provided at a cover side.
Figure 7A:
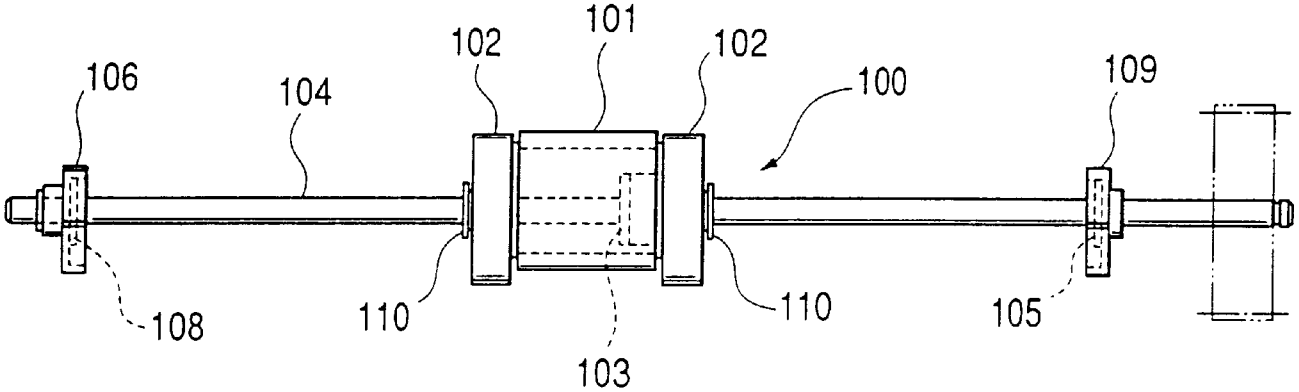
FIG. 7A (PRIOR ART)
FIGS. 7A and 7B are front views showing a conventional sheet supplying apparatus using a shaft supported at both ends.
Figure 7B:
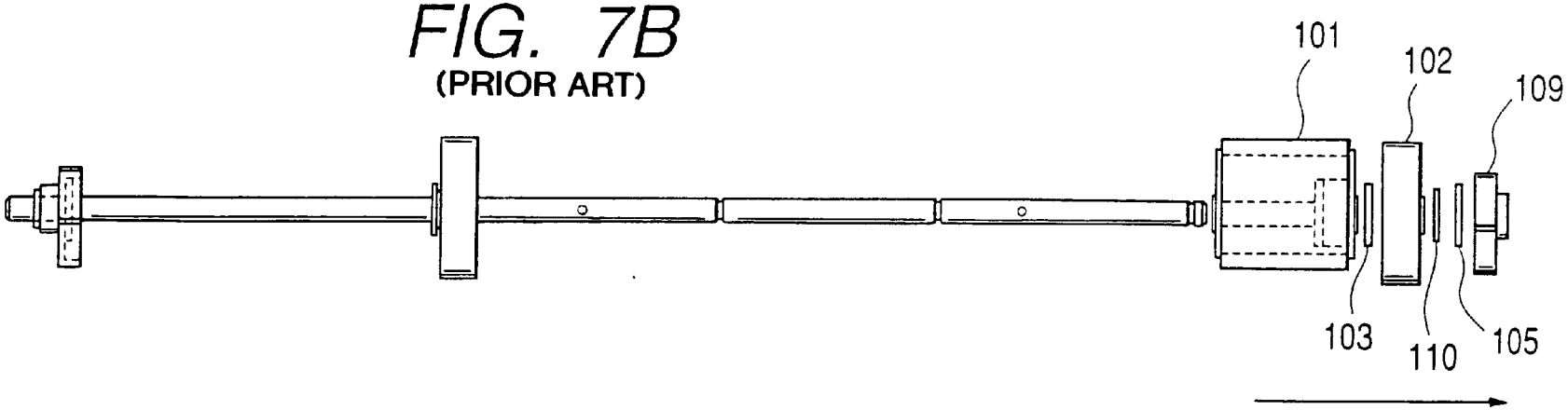
FIG. 7B (PRIOR ART)

Next, a further embodiment will be explained with reference to FIG. 6. Incidentally, elements same as or similar to the elements of the apparatus shown in FIG. 1 are designated by the same reference numerals and detailed explanation thereof will be omitted.

A process cartridge 1 can be extracted out of the apparatus through guide means (not shown) after an open/close cover 9 provided on an upper surface of a body of the apparatus is opened.

A sheet supply roller 12 of a sheet supply portion 3 is the same as that in the above-mentioned embodiments and can easily be mounted and dismounted with respect to a sheet supply shaft 11. A sheet supply cover 62 provided above the sheet supply roller 12 and adapted to cover the sheet supply roller 12 is supported by a body 60 of the image forming apparatus in such a manner that, after the process cartridge 1 is dismounted, the cover 62 can be rotated around pivot 64 within a cartridge containing portion S. In a closed condition shown by the two dot and chain line in FIG. 6, the sheet supply cover 62 also acts as a guide means for guiding a sheet fed out by the sheet supply roller 12 toward an image forming position.

With this arrangement, after the open/close cover 9 of the body 60 of the image forming apparatus is opened and the process cartridge 1 is removed, when the sheet supply cover 62 is opened within the cartridge containing portion S, the sheet supply roller 12 can be mounted/dismounted from the sheet supply shaft 11.

What is claimed is:

1. An image forming apparatus comprising:

sheet supply means for feeding stacked sheets, said sheet supply means having a detachable sheet supply roller;

image forming means for forming an image on a sheet fed by said sheet supply means, said image forming means having a process cartridge; and a cartridge containing portion for detachably containing said process cartridge within a main body of said image forming apparatus, wherein after said process cartridge is detached from said cartridge containing portion, said sheet supply roller is mounted and dismounted through said cartridge containing portion.

2. The image forming apparatus according to claim 1, wherein said sheet supply means includes an inclined sheet supply tray on which the sheets are stacked, and said process cartridge is disposed at a front side of said sheet supply tray.

3. The image forming apparatus according to claim 2, further comprising sheet discharge means for discharging and stacking the sheets on which the images have been formed by said image forming means, wherein said sheet discharge means includes an inclined sheet discharge tray on which the sheets are stacked, and said process cartridge is disposed between said sheet discharge tray and said inclined sheet supply tray.

4. The image forming apparatus according to claim 3, further comprising an open/close cover for opening and closing said cartridge containing portion in order to mount and dismount said process cartridge, wherein said sheet discharge tray also acts as said open/close cover.

5. The image forming apparatus according to claim 1, wherein said sheet supply means further includes a sheet supply shaft on which said detachable sheet supply roller is rotatably supported, and said sheet supply roller can be mounted and dismounted along a direction transverse to an axis of said sheet supply shaft.

6. The image forming apparatus according to claim 5, wherein said sheet supply shaft is supported at both ends of said sheet supply shaft by the main body of the image forming apparatus.

7. The image forming apparatus according to claim 5, further comprising a sheet supply cover for covering said sheet supply roller, wherein said sheet supply cover is supported by the main body of the image forming apparatus in such a manner that said sheet supply cover can be opened and closed within said cartridge containing portion.

8. The image forming apparatus according to claim 7, wherein said sheet supply cover also acts as a guide for guiding the sheet fed by said sheet supply roller when said sheet supply roller is covered by said sheet supply cover.

9. The image forming apparatus according to claim 7, wherein said sheet supply cover is supported in such manner as to be able to pivotally rotate about a pivotal-rotation fulcrum, wherein the stacked sheets are fed in a sheet feeding direction by said sheet supply roller, and wherein said pivotal-rotation fulcrum is provided upstream of said sheet supply roller in the sheet feeding direction.

10. The image forming apparatus according to claim 1, wherein said sheet supply roller is substantially semi-circular, wherein said sheet supply means includes a sheet supply roller unit including the substantially semi-circular sheet supply roller, a sheet supply shaft rotatably supporting said sheet supply roller, a pair of elastic sheet supply roller support portions provided on said sheet supply shaft for holding both ends of said sheet supply roller, and at least two locking means provided between said sheet supply roller and said sheet supply roller support portions for locking said sheet supply roller to said sheet supply roller support portions, and wherein at least one of said locking means is of snap-fit construction.

11. The image forming apparatus according to claim 10, wherein said at least two locking means each comprises projections provided on one of said sheet supply roller and said sheet supply roller support portions, and recesses provided on the other of said sheet supply roller and said sheet supply roller support portions, wherein said recesses can be engaged by said projections.

12. The image forming apparatus according to claim 10, wherein said locking means include a first projection and a second projection provided on each end of said sheet supply roller in the vicinity of a sheet supply tip end portion and in the vicinity of a sheet supply trail end portion, respectively, of said sheet supply roller, wherein said locking means further include a first recess and second recess provided in each of said sheet supply roller support portions to be engaged by said first and second projections, and wherein said second recesses are engaged by said second projections by snap-fit due to axial deformation of at least one of said sheet supply roller support portions.

13. The image forming apparatus according to claim 12, wherein said first projections are pin-shaped projections, said second projections are prismatic projections, said first recesses are grooves each having one end open to peripheries of said sheet supply roller support portions, and said second recesses are prismatic recesses corresponding to said second prismatic projections.

14. The image forming apparatus according to claim 12 or 13, further comprising a third locking means including additional recesses formed in the vicinity of the sheet supply trail end portion of said sheet supply roller and additional projections formed on said sheet supply roller support portions corresponding to said additional recesses.

15. The image forming apparatus according to claim 10, wherein said locking means include a first projection and a second projection provided on said sheet supply roller in the vicinity of a sheet supply tip end portion and in the vicinity of a sheet supply trail end portion, respectively, of said sheet supply roller, wherein said locking means further include a first recess and a second recess provided in said sheet supply roller support portions and corresponding to said first and second projections, and wherein said first and second recesses can be engaged by said first and second projections.

16. The image forming apparatus according to claim 15, wherein said first recess is a straight groove and said second recess is an L-shaped groove including an inlet side groove and a rear side groove, and the straight groove of said first recess and said rear side groove of said second recess extend in parallel with a diametrical direction of said sheet supply shaft, and said inlet side groove of said second recess extends in a direction perpendicular to the diametrical direction.

17. An image forming apparatus comprising:

sheet supply means for feeding stacked sheets, said sheet supply means having a detachable sheet supply roller and a sheet supply shaft for supporting said sheet supply roller;

snapping means for locking by snapping said sheet supply roller to said sheet supply shaft;

image forming means for forming an image on a sheet fed by said sheet supply means, said image forming means having a process cartridge; and a cartridge containing portion for detachably containing said process cartridge within a main body of said image forming apparatus, wherein after said process cartridge is detached from said cartridge containing portion, said sheet supply roller is mounted and dismounted through said cartridge containing portion.

18. The image forming apparatus according to claim 17, wherein said sheet supply means includes an inclined sheet supply tray on which the sheets are stacked, and said process cartridge is disposed at a front side of said sheet supply tray.

19. The image forming apparatus according to claim 18, further comprising sheet discharge means for discharging and stacking the sheets on which the images have been formed by said image forming means, wherein said sheet discharge means includes an inclined sheet discharge tray on which the sheets are stacked, and said process cartridge is disposed between said sheet discharge tray and said inclined sheet supply tray.

20. The image forming apparatus according to claim 19, further comprising an open/close cover for opening and closing said cartridge containing portion in order to mount and dismount said process cartridge, wherein said sheet discharge tray also acts as said open/close cover.

21. The image forming apparatus according to claim 17, wherein said sheet supply roller can be mounted and dismounted along a direction transverse to an axis of said sheet supply shaft.

22. The image forming apparatus according to claim 21, wherein said sheet supply shaft is supported at both ends of said sheet supply shaft by the main body of the image forming apparatus.

23. The image forming apparatus according to claim 21, further comprising a sheet supply cover for covering said sheet supply roller, wherein said sheet supply cover is supported by the main body of the image forming apparatus in such a manner that said sheet supply cover can be opened and closed within said cartridge containing portion.

24. The image forming apparatus according to claim 23, wherein said sheet supply cover also acts as a guide for guiding the sheet fed by said sheet supply roller when said sheet supply roller is covered by said sheet supply cover.

25. The image forming apparatus according to claim 23, wherein said sheet supply cover is supported in such manner as to be able to pivotally rotate about a pivotal-rotation fulcrum, wherein the stacked sheets are fed in a sheet feeding direction by said sheet supply roller, and wherein said pivotal-rotation fulcrum is provided upstream of said sheet supply roller in the sheet feeding direction.

26. The image forming apparatus according to claim 17, wherein said sheet supply roller is substantially semi-circular, wherein said snapping means includes a sheet supply roller support portion provided on said sheet supply shaft, and wherein said sheet supply roller is locked by snapping between said sheet supply roller and said sheet supply roller support portion.

27. The image forming apparatus according to claim 26, wherein said snapping means comprises a projection provided on one of said sheet supply roller and said sheet supply roller support portion, and recesses provided on the other of said sheet supply roller and said sheet supply roller support portion, wherein said projection can be snapped into said recess.

28. The image forming apparatus according to claim 26, wherein a pair of said sheet supply roller support portions on said sheet supply shaft are provided, one on each end of said sheet supply roller.

29. An image forming apparatus comprising:

sheet supply means for feeding stacked sheets, said sheet supply means having a detachable sheet supply roller and a sheet supply shaft for supporting said sheet supply roller;

holding means for detachably holding said sheet supply roller on said sheet supply shaft, without use of a fixing member for fixing said sheet supply roller on said sheet supply shaft, wherein said fixing member is inserted in an orthogonal direction of an axis of said sheet supply shaft;

image forming means for forming an image on a sheet fed by said sheet supply means, said image forming means having a process cartridge; and a cartridge containing portion for detachably containing said process cartridge within a main body of said image forming apparatus, wherein after said process cartridge is detached from said cartridge containing portion, said sheet supply roller is mounted and dismounted through said cartridge containing portion.

30. An image forming apparatus according to claim 29, wherein said holding means is of snap-fit construction.

31. An image forming apparatus according to claim 30, wherein said snap-fit construction is comprised of a projection provided on one of said sheet supply roller and a support affixed relative to said sheet supply shaft, said projection snapped into a recess provided on the other of said sheet supply roller and said support affixed relative to said sheet supply shaft.

32. An image forming apparatus according to claim 29, wherein said sheet supply means includes an inclined sheet supply tray on which the sheets are stacked, and said process cartridge is disposed at a front side of said sheet supply tray.

33. An image forming apparatus according to claim 32, further comprising sheet discharge means for discharging and stacking the sheets on which the images have been formed by said image forming means, wherein said sheet discharge means includes an inclined sheet discharge tray on which the sheets are stacked, and said process cartridge is disposed between said sheet discharge tray and said inclined sheet supply tray.

34. An image forming apparatus according to claim 33, further comprising an open/close cover for opening and closing said cartridge containing portion in order to mount and dismount said process cartridge, wherein said sheet discharge tray also acts as said open/close cover.

35. An image forming apparatus according to claim 29, wherein said sheet supply roller can be mounted and dismounted along a direction transverse to the axis of said sheet supply shaft.

36. An image forming apparatus according to claim 35, wherein said sheet supply shaft is supported at both ends of said sheet supply shaft by the main body of the image forming apparatus.

37. An image forming apparatus according to claim 35, further comprising a sheet supply cover for covering said sheet supply roller, wherein said sheet cover is supported by the main body of the-image forming apparatus in such a manner that said sheet supply cover can be opened and closed within said cartridge containing portion.

38. An image forming apparatus according to claim 37, wherein said sheet supply cover also acts as a guide for guiding the sheet fed by said sheet supply roller when said sheet supply roller is covered by said sheet supply cover.

39. An image forming apparatus according to claim 37, wherein said sheet supply cover is supported in such manner as to be able to pivotally rotate about a pivotal-rotation fulcrum, wherein said pivotal-rotation fulcrum is provided on the inclined sheet supply tray side of said sheet supply cover, and the sheets are stacked for image formation at an upstream side of said sheet supply roller disposed at the main body of said image forming apparatus in a sheet feeding direction.

* * * * *

UNITED STATES PATENT AND TRADEMARK OFFICE

CERTIFICATE OF CORRECTION

PATENT NO. : 6,300,970 B1
DATED : October 9, 2001
INVENTOR(S) : Tatsuo Hamada et al.

It is certified that error appears in the above-identified patent and that said Letters Patent is hereby corrected as shown below:

Column 2,
Line 11, "120a" should read -- 120b --.

Column 3,
Line 17, "near" should read -- rear --.

Column 12,
Line 6, "the-image" should read -- the image --.

Signed and Sealed this

Twelfth Day of March, 2002

*Attest:*

*Attesting Officer*

JAMES E. ROGAN
*Director of the United States Patent and Trademark Office*